United States Patent [19]

Veazey

[11] 4,142,279

[45] Mar. 6, 1979

[54] APPARATUS FOR TREATING A TOW OF FILAMENTS WITH A LIQUID

[75] Inventor: Thomas M. Veazey, Decatur, Ala.

[73] Assignee: Monsanto Company, Decatur, Ala.

[21] Appl. No.: 821,262

[22] Filed: Aug. 3, 1977

[51] Int. Cl.[2] ..... D02G 1/00

[52] U.S. Cl. ..... 28/219; 34/159; 34/161; 68/6; 68/181 R

[58] Field of Search ..... 19/65 T, 66 T, 66 R; 28/219, 283; 68/6, 18 R, 5 D; 34/155, 159, 160, 161; 226/119; 8/151

[56] References Cited

U.S. PATENT DOCUMENTS

| | | | |
|---|---|---|---|
| 3,267,704 | 8/1966 | Muller | 68/181 R X |
| 3,353,380 | 11/1967 | Taylor, Jr. | 68/181 R |

*Primary Examiner*—Dorsey Newton

*Attorney, Agent, or Firm*—Robert L. Broad, Jr.

[57] ABSTRACT

An apparatus for treating a tow of filaments with a fluid, the apparatus forming a tow path therethrough and having a pair of guide surfaces positioned on opposite sides of the tow in series with each other in such a manner that the two path has at least two bends. Fluid nozzles associated with each of the guide surfaces are positioned in such a manner that fluid from these nozzles flows in layers along the guide surfaces and passes through the tow at the bends in the two path. This apparatus is capable of treating a tow under little or no tension, so that it can be used to anneal and shrink tows of certain filaments. The moving fluid advances the tow through the apparatus.

7 Claims, 2 Drawing Figures

APPARATUS FOR TREATING A TOW OF FILAMENTS WITH A LIQUID

BACKGROUND OF THE INVENTION a. Field of the Invention

This invention relates to apparatus for treating tow with fluid.

b. Description of the Prior Art

In the manufacture of acrylic filaments by certain processes, it is necessary to anneal or heat treat the filaments and allow them to shrink in order to prevent subsequent filament fibrillation. The conventional method of annealing acrylic filaments is a batch process, where a tow of the filaments is placed in an autoclave and the autoclave filled with steam under pressure. A disavantage of this method is that it is a batch process. Also, excessive handling of the filaments is required.

Attempts have been made to anneal acrylic tows by continuous processes at steam pressures above atmospheric. In some of these attempts, tows were passed through a chamber containing steam under pressure and having seals at each end through which the tow is passed. These devices suffered from poor sealing and excessive wear of the seals.

Attempts have been made to anneal acrylic tow using steam at atmospheric pressure in a device having no seals. In these devices, steam penetration of the tow has been poor and frequently the tension necessary to pull the tow through the device has prevented adequate tow shrinkage. Unless the tow is allowed to shrink, the filaments will tend to fibrillate under conditions of usage.

SUMMARY OF THE INVENTION

Apparatus for treating a tow with a fluid comprising a housing having a tow passageway therethrough and including a pair of guide surfaces positioned on opposite sides of the tow and in series with each other in such a manner that the tow path has at least two bends. Fluid nozzles associated with the guide surfaces are positioned to direct streams of fluid forward along these surfaces in layers to the bends in the path, the bends in the tow path being such that the fluid flow separates from the surface, impinges upon and bends and at the same time lifts the tow out of contact with the guide surfaces. The fluid advances the tow through the apparatus under a tension which is sufficiently low that the tow is free to shrink.

DETAILED DESCRIPTION OF THE INVENTION

Figure 1:
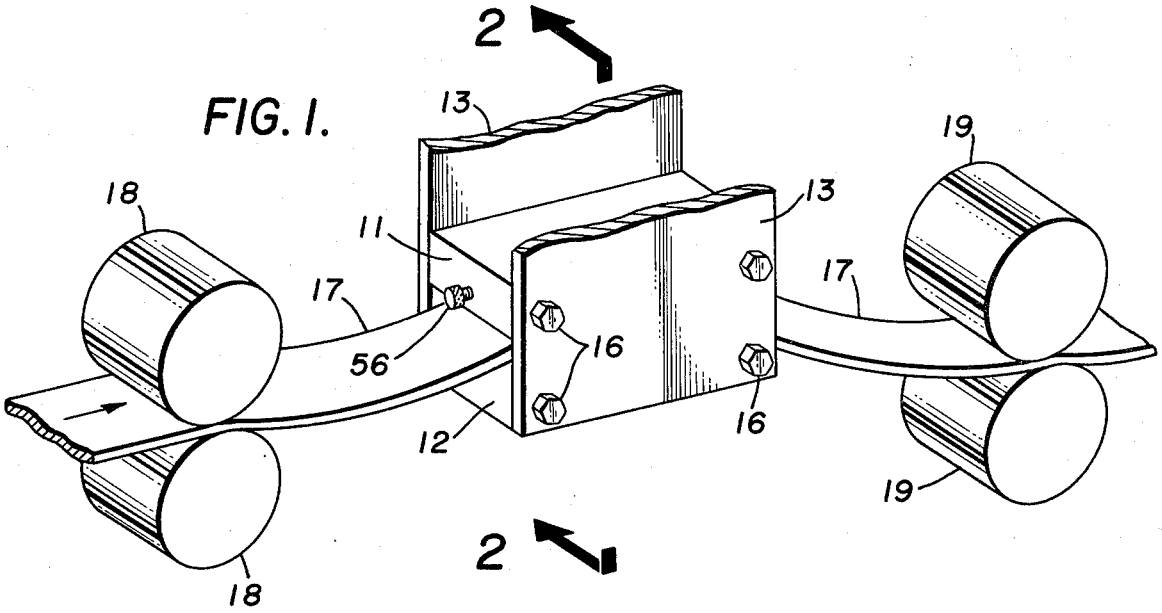
FIG. 1 is a perspective view of the apparatus of this invention showing the general construction of the apparatus.
Figure 2:
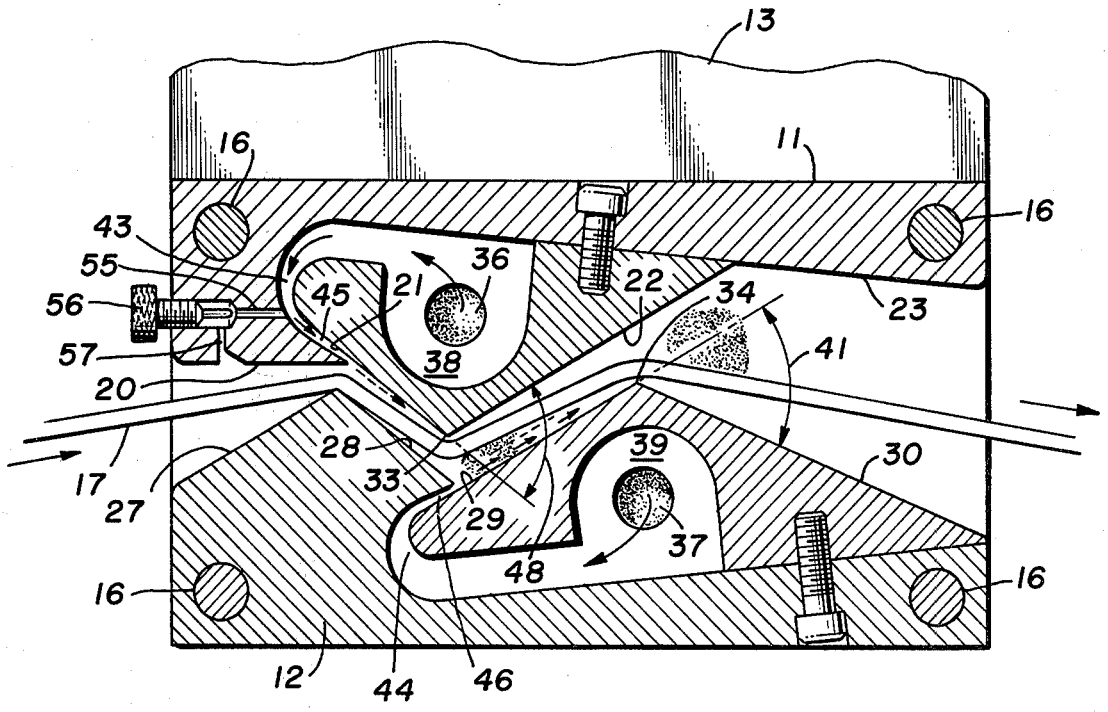
FIG. 2 is a longitudinal cross-section of the apparatus taken along line 2—2 of FIG. 1 showing the tow path through the apparatus.

Referring now in detail to the drawing, there is shown a tow treatment apparatus made up of an upper member 11 and a lower member 12 positioned between side plates 13, these four elements being secured together by bolts 16. A tow 17 to be treated is passed through the apparatus along a tow path formed by lower surfaces of the upper member 11 and upper surfaces of the lower member 12. This tow path, which has a sawtooth configuration when viewed from the side, is best shown in FIG. 2. The tow 17 is fed to the treating apparatus by feed rolls 18 and is moved away from the apparatus by takeup rolls 19 (FIG. 1).

The upper limit of the tow path is defined by downwardly-facing inlet surface 20, guide surface 21, "downstream" surface 22 and outlet surface 23 on the upper member 11, these surfaces being connected in series as shown (FIG. 2). The lower limit of the tow path is defined by upwardly-facing inlet surface 27, surface 28, guide surface 29 and "downstream" surface 30 on the lower member 12, those surfaces being connected in series as shown. The surfaces 21 and 29 are referred to as "guide" surfaces, in that, if the tow is pulled through the apparatus under tension and without the use of a fluid, as described below, the tow will be guided through a path of bends by the trailing edges of these surfaces. The trailing edges of the surfaces 21 and 29 are indicated in FIG. 2 by reference numbers 33 and 34, respectively.

The surfaces 22 and 30 might be referred to as "downstream" surfaces in that these surfaces are downstream of and connect with or intersect the guide surfaces 21 and 29, respectively. The guide surfaces 21 and 29 and their respective downstream surfaces form a sawtooth tow path through the apparatus. It will be noted that the guide surfaces 21 and 29 are on the front of the sawtooth pattern, relative to the direction of travel of the tow, and the downstream surfaces are on the rear of the sawtooth pattern. The downstream surfaces 22 and 30, being positioned on the rear of the sawtooth tow path, are not contacted by the tow.

The upper and lower members 11 and 12 are provided with, respectively, fluid inlets 36 and 37, fluid manifolds 38 and 39 and curved fluid channels 43 and 44, leading to nozzles 45 and 46. The preferred fluid for use in this apparatus is steam. The construction of the nozzles 45 and 46 is such that the steam exits from these nozzles in flat sheets or layers in contact with the guide surfaces. Steam admitted under pressure through the inlet 36 into the manifold 38 in the upper member 11 will exit from the nozzle 45 at a high velocity and travel down the guide surface 21 in a layer. The Coanda effect causes the steam to cling to the guide surface 21 in a layer, thereby "lubricating" the passage of the tow along this surface. The downstream surface 22 meets the guide surface 21 at an angle 48, shown in FIG. 2, greater than 45°. The purpose of making this bend (angle 48) greater than 45° is to insure that the layer of steam will separate from the surface 21 and pass through the tow at the trailing edge 33 of the surface 21. In addition to annealing the tow as it passes therethrough, the moving steam lifts the tow out of contact with the trailing edge 33 and urges the tow forward through the apparatus.

In a like manner, steam from the nozzle 46 will, because of the Coanda effect, travel up the guide surface 29 in a layer to lubricate this surface for passage of the tow 17. The guide surface 29 meets the downstream surface 30 at an angle 41 of greater than 45° to insure that the layer of steam will separate from the guide surface 29 and pass through the tow at the trailing edge 34 of the surface 29. In addition to annealing the tow as it passes therethrough, the moving layer of steam passing along the surface 29 will lift the tow out of contact with the trailing edge 34 and will urge the tow forward through the apparatus.

If the angles 48 and 41 are too small, or if the trailing edges 33 and 34 are rounded off too much, the steam will, because of the Coanda effect, flow in a layer from the guide surfaces onto the downstream surfaces without passing through the tow.

Because of the movement of the steam and tow through the apparatus, there will be a tendency for ambient air to be aspirated into the inlet end of the passageway. Ambient air entering the inlet of the passageway will tend to cool the tow and thereby decrease the effectiveness of the steam annealing of the tow. To avoid this, a passageway 55 in the upper member 11 leads from the nozzle 45 past an adjustable needle valve 56 to a passageway 57 extending through the surface 20 of the upper member 11. Steam moving through the passageways 55 and 57 blankets the inlet end of the tow path in such a manner that ambient air is not aspirated into the treating zone. The amount of blanketing steam present at the inlet end of the tow path is controlled by the needle valve 56. The length of the treatment zone is indicated in FIG. 2.

In operation, the tow 17 is passed through the apparatus as illustrated in FIG. 2. Steam flows from the nozzles 45 and 46 along the guide surfaces 21 and 29, respectively, in layers to lubricate these surfaces and to move the tow through the apparatus. At the trailing edges 33 and 34 of the surfaces 21 and 29, respectively, the moving steam passes through the tow and, in doing so lifts the tow out of contact with these trailing edges and moves the tow forward through the apparatus. The tow remains out of contact with the apparatus while in the treatment zone, being supported and advanced by the streams of steam. The takeup rolls 19, which rotate at a lower peripheral speed than the feed rolls 18, exert a tension on the tow which is less than the shrinking tension of the tow, so that the tow is free to shrink under the influence of the steam.

It is not necessary to use the takeup rolls 19. The tow exiting from the apparatus may be deposited on a moving belt or fed directly into a container.

What is claimed is:

1. An apparatus for treating a tow of filaments with a fluid, comprising:

a. an upper member having a downwardly-facing first guide surface, b. a lower member positioned below the upper member and having an upwardly-facing second guide surface, c. said members and said guide surfaces being on opposite sides of the tow and so positioned that the path of the tow is bent upward at the trailing edge of the downwardly-facing surface, and d. nozzles associated with each of said surfaces for directing streams of treatment fluid in layers along said surfaces, each of said nozzles being positioned relative to its associated guide surface in such a manner that the stream of treatment fluid from said nozzles will flow in a layer along said guide surface, e. said trailing edges of the guide surfaces being constructed in such a manner that the streams leave the surfaces at said trailing edges and pass through the tow.

2. The apparatus of claim 1 wherein the apparatus is provided with side plates secured to the upper and lower members to form an enclosed tow path through the apparatus, said tow path having an inlet end and a sawtooth configuration.

3. The apparatus of claim 2 wherein the upper and lower members are each provided with downstream surfaces which intersect the guide surfaces at angles greater than about 45°.

4. The apparatus of claim 3 wherein the upper and lower members are provided with fluid manifolds and fluid inlets leading to the nozzles.

5. The apparatus of claim 4 wherein one of the members is provided with a passageway leading from the fluid inlet to said inlet end of said tow path.

6. An apparatus for treating a tow of filaments, comprising:

a. a pair of side plates;

b. an upper member mounted between the side plates and having a downwardly facing guide surface connected to a downstream surface at an angle of at least 45°;

c. a lower member mounted between the side plates and having an upwardly-facing guide surface connected to a downstream surface at an angle of at least 45°, said guide surfaces and downstream surfaces defining a sawtooth tow path through the apparatus;

d. each of said members having a fluid manifold connected by a fluid inlet to a fluid nozzle, said fluid nozzles being positioned and adapted to direct a stream of fluid in a sheet configuration onto its respective guide surface;

e. one of said members having a passageway leading from the fluid inlet to the inlet end of the tow path for feeding fluid into said inlet end; and f. means in said passageway for adjusting the amount of fluid fed to said inlet end.

7. The apparatus of claim 6 wherein a pair of feed rolls are positioned to feed the tow into the apparatus.

* * * * *